United States Patent [19]

Arthur

[11] Patent Number: 4,661,090

[45] Date of Patent: Apr. 28, 1987

[54] FILTER ROD MANUFACTURE

[75] Inventor: Hugh M. Arthur, High Wycombe, United Kingdom

[73] Assignee: Molins PLC, United Kingdom

[21] Appl. No.: 641,958

[22] PCT Filed: Dec. 13, 1983

[86] PCT No.: PCT/GB83/00331

§ 371 Date: Aug. 10, 1984

§ 102(e) Date: Aug. 10, 1984

[87] PCT Pub. No.: WO84/02257

PCT Pub. Date: Jun. 21, 1984

[30] Foreign Application Priority Data

Dec. 13, 1982 [GB] United Kingdom ..... 8235458

[51] Int. Cl.[4] ..... B31C 13/00

[52] U.S. Cl. ..... 493/44; 493/42

[58] Field of Search ..... 493/42, 44, 47, 48, 493/49, 50, 941; 57/328; 28/221, 255, 265; 19/150; 156/441, 180

[56] References Cited

U.S. PATENT DOCUMENTS

| | | | |
|---|---|---|---|
| 3,120,690 | 2/1964 | Stevens | 156/178 |
| 3,161,557 | 12/1964 | Müller | 493/42 |
| 3,313,665 | 4/1967 | Berger | 156/180 |
| 3,323,961 | 6/1967 | Gallagher | 156/180 |
| 3,401,429 | 9/1968 | Whitehurst | 19/150 |
| 3,418,890 | 12/1968 | Tachibana et al. | 493/42 |
| 3,813,996 | 6/1974 | Labbe et al. | 493/44 |
| 3,847,064 | 11/1974 | Berger | 493/44 |
| 3,924,311 | 12/1975 | Stanley | 28/221 |
| 4,183,202 | 1/1980 | Morihashi | 57/328 |
| 4,237,685 | 12/1980 | Pelagio et al. | 57/328 |
| 4,248,139 | 2/1981 | Labbe | 493/4 |
| 4,537,583 | 8/1985 | Pryor | 493/42 |
| 4,549,875 | 10/1985 | Pryor | 493/44 |

FOREIGN PATENT DOCUMENTS

| | | |
|---|---|---|
| 377263 | 4/1964 | Switzerland . |
| 1387404 | 3/1975 | United Kingdom . |
| 1588506 | 4/1981 | United Kingdom . |
| 1588507 | 4/1981 | United Kingdom . |
| 1588508 | 4/1981 | United Kingdom . |

*Primary Examiner*—Frederick R. Schmidt
*Assistant Examiner*—Robert Showalter
*Attorney, Agent, or Firm*—Antonelli, Terry & Wands

[57] ABSTRACT

In the production of cigarette filter rod from filter tow the conveyance of tow into a tow shaping unit (12, 32, 56, 76) is aided by controlling tow tension so that excessive stretch (and hence possible loss of crimp) is avoided. The tension is controlled by two conveying arrangements upstream of the tow shaping unit and which may include air extracting devices and entraining devices (20–28), opposed tow engaging wheels (34, 36), a tow reservoir (64), a tow engaging refuser roller (70), or a tow spinning unit (74). In the tow spinning unit (74) the tow is gathered ad twisted in a converging conical guide which is rotated at high speed, and which may also impart an axial thrust to the tow to aid conveyance into the tow shaping unit (76).

20 Claims, 4 Drawing Figures

FILTER ROD MANUFACTURE

This invention relates to the production of continuous cigarette filter rod from a tow of filter material.

An important characteristic of a cirgarette filter rod is its pressure drop per unit length, because of its close relationship to the filtration efficiency of filters produced from the rod. At low manufacturing speeds rods with a range of weights per unit length and diameters can be produced from a given tow type and these will correspondingly have a range of pressure drops. Generally, rods which have weights corresponding to the upper end of this so-called tow capability range have a greater pressure drop to weight ratio and are consequently more economical to manufacture. At high manufacturing speeds the tow capability range is reduced, so that the uppermost weights obtainable at low speeds can no longer be obtained.

Several factors may contribute to the loss in tow capability range. Tow is visco-elastic and at low speeds crimp which is removed by stretching in the tow opening process recovers before the tow reaches the garniture. At higher speeds there is insufficient time for full recovery, so that filter rod produced from the tow has fewer laterally orientated fibres and therefore presents a lower pressure drop. Another possible factor is that the tow entrains air as it is drawn through the reducing cross-section of the collating tongue leading to the garniture of a rod making machine and the entrained air is expelled, generally by counter flow to the mouth of the tongue. This counter flow air produces a drag on the tow which increases at least with the square of increase of rod speed. As a result of this drag the tension needed to pull the tow through the garniture is high, so that again the tow is stretched and crimp is lost. Drag is also induced by friction as the tow is drawn over the inner surface of the tongue.

The present invention is based on an appreciation that if the tow can be delivered to a garniture of a rod making machine in a relatively relaxed state, in particular without substantial loss of crimp, the tow capability will be retained at high rod speeds. Further at the downstream end or throat of the tongue the cross-section is relatively small and the ratio of the circumference of the tow surface in contact with the stationary tongue to that in contact with the driving tape is approaching a minimum. Therefore, if the tow can be presented at the downstream end of the tongue substantially without loss of crimp it is possible to extend the tow capability range at high manufacturing speeds. Preferably the tow is not subjected to excessive stretch, or if it is stretched it is given time to recover. In a preferred aspect of the invention the tow is subjected to conveying means between a tow opening unit and a rod forming unit the conveying means being arranged to reduce at least locally the longitudinal force required to convey the tow towards the rod forming unit, preferably at least just upstream of the rod forming unit.

The invention further relates to a machine for making continuous filter rod, comprising means such as a tongue for shaping and possibly compressing the filter tow prior to its entry into a rod forming unit, including means adapted to drive tow into at least a downstream portion of the tongue without stretching the tow in said portion. An object of the invention is to enable operation of a rod making machine at high speeds (up to 600 m/min) without loss of crimp of filter tow as it is passed through the rod making unit.

It has already been proposed, in British patent specification No. 1387404, that a driven conveyor such as a wheel or band, be used to assist driving of the tow through a tongue. Suction may be applied to the conveyor. Other arrangements for feeding tow towards a tongue are disclosed in U.S. Pat. No. 4,248,139.

The above-mentioned drive means may include pneumatic means arranged to extract entrained air from the tow as it is compressed in or upstream of the tongue and also to create an additional air flow in the direction of conveyance of the the tow to assist conveyance of the tow towards and/or in the tongue. The pneumatic means preferably comprises a hollow probe which extends longitudinally inside the tongue and which is connected to a source of suction. Preferably the probe has an air inlet facing the garniture in a downstream portion of the tongue.

The drive means may comprise a pair of laterally spaced conveyors which engage and compress the tow in the region of the tongue. Preferably the conveyors are wheels which engage the tow adjacent a downstream portion of the tongue between the tongue and the wrapper on which the tow is conveyed. The wheels or other conveyors may be provided with spikes or bristles which not only increase engagement with the tow but also readily allow escape of air from the tow. Similar wheels could be used with any of the arrangements disclosed in the aforementioned U.S. Pat. No. 4,248,139 The wheels could be provided with suction.

The invention includes the provision of a "bustle" or reservoir for tow which is created upstream of the tongue and provides a region in which the tension in the tow is relaxed, thereby allowing recovery of the tow prior to entry into the tongue and rod forming unit. The exit from the reservoir is arranged such that tow is withdrawn from the reservoir at the rate required by the rod making unit without causing excessive stretch. Air transport jets may be used to drive tow into the reservoir. Alternatively, or additionally, the speed of the tow opening machine may be increased to deliver tow at the required rate which allows the rod making unit to function without excessively stretching the tow. The reservoir is preferably provided with a downstream exit which is substantially of the same size as that required for entry into the rod forming unit, so that the function of the tongue is reduced largely to shaping the tow (rather than shaping and condensing).

According to another aspect of the invention a machine for making continuous filter rod comprises means for feeding tow towards a rod making unit, and means upstream of the rod making unit for spinning or twisting the tow. Preferably the twisting means is located between a tow opening unit and a tongue which finally shapes the tow prior to its entry into the rod forming unit. The twisting means preferably comprises a spinning unit through which the tow passes and in which it is gathered. The unit may comprise a converging portion which is rotated at high speed and which engages the tow and spins or twists its. The unit may include air flow means such as one or more transport jets arranged to convey the tow into and/or through the unit. The air flow means may be arranged to assist the twisting or spinning of the tow fibres, e.g. by having transverse as well as longitudinal components of flow. The twisting means may comprise other spinning means, e.g. contra-rotating friction wheels as used in the textile industry for spinning. In a preferred arrangement the twisting means is arranged to impart axial thrust to the spun tow. Referring, therefore, to the previous aspects of the invention said drive means may include said twisting means.

By spinning the tow fibres to produce a relatively short pitch helix the tow is both longitudinally and radially compressed and entrained air is forced out. Since the fibres in the finished rod will have significant lateral or transverse portions (as compared with conventionally produced filter rod) the pressure drop of finished rods may be less dependent on crimp loss.

The invention will be further described, by way of example only, with reference to the accompanying diagrammatic drawings, in which.

Figure 1:
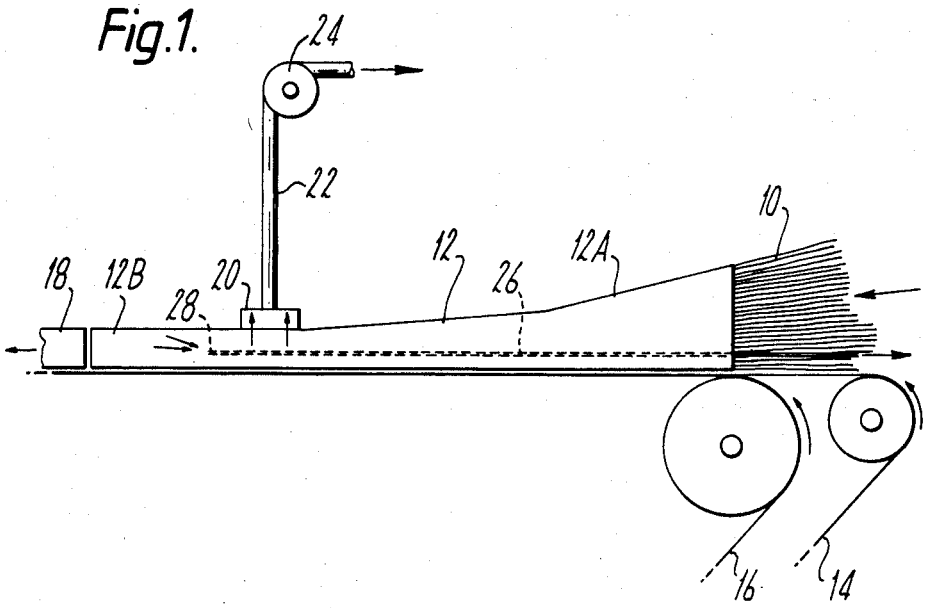
FIG. 1 is a side view of part of a machine for making continuous filter rod.

FIG. 1 shows a stream 10 of filter tow delivered from a tow opening machine, such as Molins TO5 machine, in which the tow is deregistered of "bloomed", passing into a tongue 12 of a continuous rod making machine, which may be similar to Molins PM5N machine. The tongue 12 comprises a relatively wide converging upstream part or trumpet 12a and a narrower downstream part or throat 12B, the change in size and shape of the tongue along its length being progressive or in relatively small transitions. The tow stream 10 passes into the tongue 12 and is progressively condensed, shaped and pressed onto a continuous wrapper 14 conveyed by a garniture tape 16. At the downstream end of the throat 12B the tow stream 10 has reached substantially its final cross-sectional area and the stream and wrapper 14 pass into a garniture 18 in which the wrapper is folded and sealed around the tow to form a continuous rod.

In order to remove excess air entrained with the tow stream 10 a suction chamber 20 communicated with the tongue 12, preferably at the downstream part 12B. The chamber 20 is connected to a pipe 22 loading to an air pump 24 (or other suction source). Air may be withdrawn from the inside of the tongue 12 and passed into the chamber 20 at a rate which is greater than that required to remove the excess air entrained with the tow stream 10. Additional air is drawn into the chamber 20 largely in the direction of conveyance of the tow stream 10 through the tongue 12 (since resistance to air flow in the downstream part 12B of the tongue is higher than that in the upstream part 12A) so that the net effect of applying over-suction at the chamber 20 is to aid conveyance of the tow stream into and through the tongue 12.

In addition to or as an alternative to the chamber 20 air may be withdrawn from the interior of the tongue 12 through a hollow probe 26 which extends substantially longitudinally of the tongue 12 and is connected upstream (at a position beyond the entry to the tongue) to a source of suction. The probe 26 includes at least one inlet 28 at or near its end, which inlet may be the sole inlet. Air may be withdrawn from the tow within the tongue 12 by the probe 26 in a manner similar to that described with reference to the chamber 20. An advantage of the use of a probe 25 as compared with that of the chamber 20 is that there is no problem with sealing a connection to the tongue 12. The probe 25 is sufficiently thin so that little interference is caused to the passage of the tow through the tongue 12. Where a single air inlet 28 is provided at the downstream end of the probe 26 there is little risk of tow blocking the inlet since the air flow is abruptly reversed at the position of the inlet and the momentum and positive drive of the tow is such that no corresponding reversal of its movement takes place.

Figure 2:
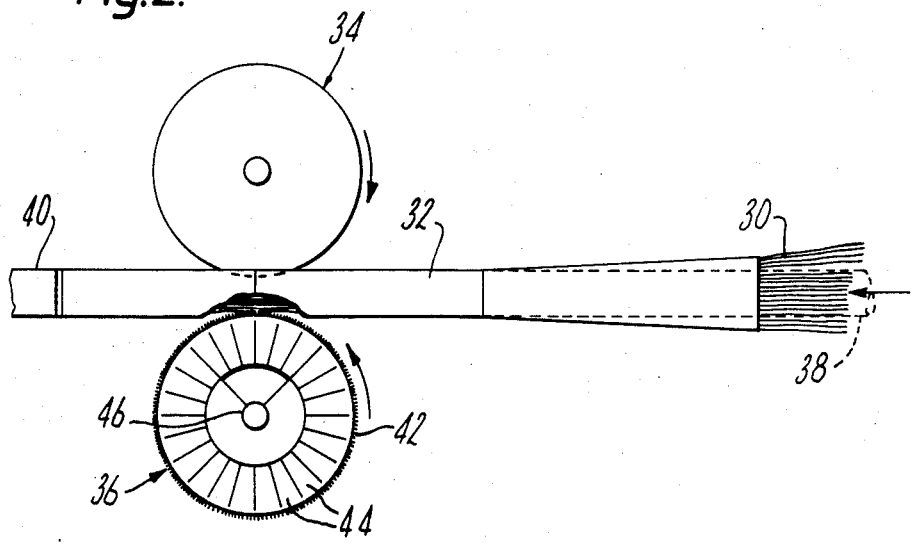
FIG. 2 is a plan view of part of another machine for making continuous filter rod.

FIG. 2 is a plan view of another arrangement, in which a tow stream 30 passes into a tongue 32. Adjacent the downstream part of the tongue 32 a pair of cooperating transverse wheels 34, 36 arranged to be driven about substantially vertical axes engages the side of the tow stream 30 between the tongue and a continuous wrapper 38. Downstream of the tongue 32 the tow stream 30 and wrapper 38 pass into a garniture 40. As indicated on the wheel 36 the wheels 34, 36 may have peripheral radial spikes or brushes 42 which assist traction between the respective wheel and the tow and also allow air to escape from the tow. In addition one or both of the wheels 34, 36 could be provided with vanes defining radial chambers 44 communicating with an internal stationary suction manifold 46, whereby air may be positively withdrawn from the tow. Wheel similar to the wheels 34, 36 could be located anywhere along the length of the tongue 32, or just upstream of the tongue to aid entry of the tow into the tongue.

Figure 3:
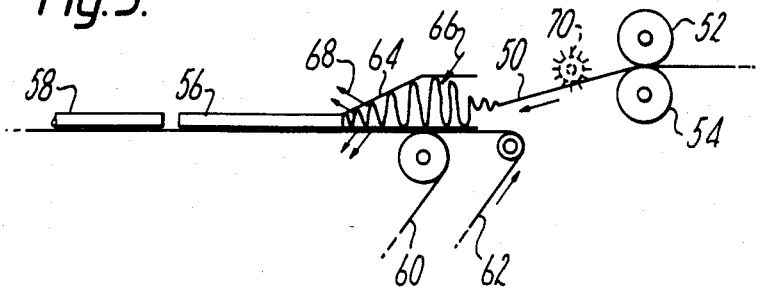
FIG. 3 is a side view of part of a further machine for making continuous rod.

FIG. 3 shows a stream 50 of filter tow leaving the final cooperating rolls 52, 54 of a tow opening machine and passing towards a rod making machine which includes a tongue 56, garniture 58 and a garniture tape 60 carrying a continuous wrapper 62. At the entrance to the tongue 56 a "bustle" or temporary tow reservoir 64, in which the tow is slowed and gathered into loops, is provided. In the reservoir 64 the tension on the tow is relaxed and loss in crimp caused by passage through the tow is relaxed and loss in crimp caused by passage through the tow opening machine is recovered. Tow may be driven into the reservoir by conventional air transport jets, as indicated at 66. Air may be withdrawn at the downstream part of the reservoir 64 as indicated at 68. Alternatively, or additionally, air may be withdrawn from the tongue 56, as provided in the arrangements of FIG. 1 or FIG. 2, or as disclosed in the aforementioned U.S. Pat. No. 4,248,139.

The reservoir 64 may reduce in cross-sectional area so that tow passing from the reservoir is already condensed substantially to the size required for entry into the garniture 58. Thus, the reservoir 64 performs a substantial part of the work normally performed by a conventional tongue. The tongue 56 merely shapes the tow for delivery to the garniture 58. The advantage of the use of a reservoir 64 to assemble a buffer of tow is that time is given for air to escape from the tow and the tow is precompressed before entry into the tongue and garniture without being excessively stretched.

A reservoir similar to the reservoir 64 could be positioned substantially at any position between the tongue 56 and the delivery rolls 52, 54 of the tow opening machine. Some of the advantages derived from a buffer of tow such as is created in the reservoir 64, especially in respect of allowing visco elastic recovery of the tow after passage through the tow opening machine, may be achieved by use of one or more refuser rollers, as indicated at 70 in FIG. 3, between the rolls 52, 54 and the tongue 56. The refuser roller 70 may be controlled to relax the upstream tension on the tow to allow crimp recovery. Thus, the roller 70 is controlled so that the upstream tow is relaxed, i.e., the speed of the roller is less than that of the rolls 52, 54.

One method whereby a reservoir or mass of tow under reduced tension may be created between the tow opening machine and the rod making machine is to run the tow opening machine, or at least the final drive rolls 52, 54, at a speed in excess of that required to maintain tow under normal tension between the machines.

Figure 4:
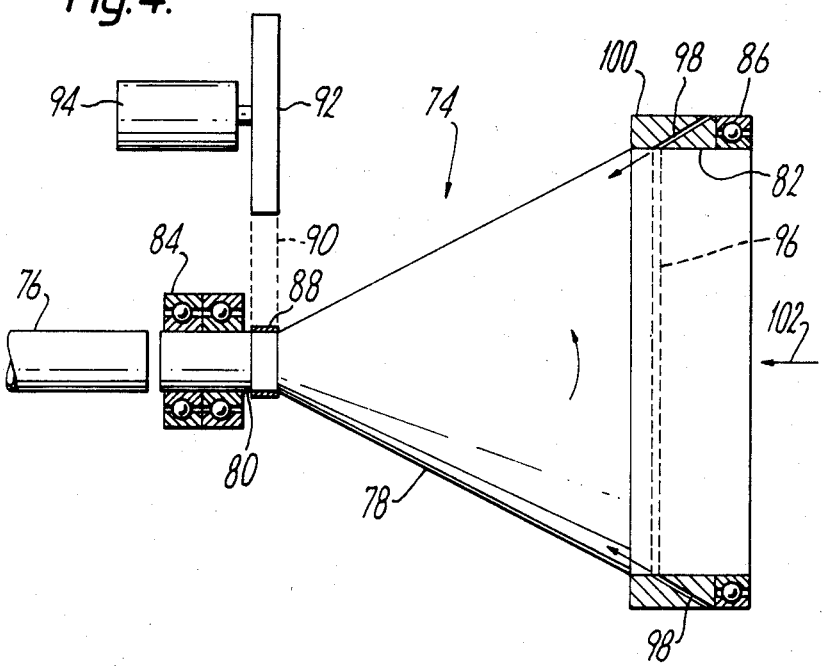
FIG. 4 is a plan view of part of yet another machine for making continuous rod.

FIG. 4 is a plan view of a further arrangement for feeding a stream of tow into the garniture of a rod making machine. A tow spinning unit 74 is arranged just upstream of a tongue 76. The unit 74 comprises a converging conical part 78 arranged between small and large diameter cylindrical parts 80, 82, respectively. The whole unit 74 is roatably mounted in bearings 84, 86. The part 80 carries a small diameter pulley 88 which is driven by a belt 90 from a large diameter pulley 92 connected to the shaft of an electric motor 94. The large diameter part 82 of the unit 74 includes a series of slots 96 which register with an annular series of air supply passages 98 arranged in a housing 100 for the bearing 86. The provision of slots 96 and air supply passages 98 with the unit 74 is optional.

A stream of tow passes in the direction of arrow 102 from a tow opening machine into the tow spinning unit 74. The unit 74 is rotated at high speed (in excess of 1000 r.p.m. and preferably up to 10,000 r.p.m. or more). As a result of friction between the outer layers of tow and the inner surface of the unit 74 the tow is twisted and axially compressed as it passes to the smaller diameter part 80 of the unit 74. Air jets from the passages 98 assist in driving the tow into the unit 74 and also impart a rotary motion to the tow, in view of the movement of the slots 96 past the passages 98. The passages 98 could be appropriately angled to increase the transverse component of the air motion. The tow emerging from the unit 74 may be of substantially the cross-sectional size required for entry to the garniture. As with the FIG. 3 arrangement, therefore, the tongue 76 may merely assist final shaping of the tow before entry to the garniture. As previously explained, there is good driving contact between the tow and the wrapper and garniture tape at this position, so that substantially no further loss of crimp can occur after the unit 74. After passing through the spinning unit 74 the tow may be quite tightly twisted with a pitch in the order of 10–100 mm.

The arrangement of FIG. 4 could be used in combination with other arrangements disclosed herein or in the aforementioned U.S. Pat. No. 4,248,139. In particular, means may be provided at or near the downstream part of the spinning unit 74 or in or adjacent the tongue 76 for withdrawing any excess air, although the spinning process is largely responsible for driving air from the tow.

If necessary the unit 74 could be arranged to impart an axial thrust to the spun rod, for example by forming the cone 78 with appropriate threads or projections.

The unit 74 need not be arranged in line with the tongue 76 and garniture but may be angled towards it in a manner similar to the unit 40 in FIG. 3 of the aforementioned U.S. Pat. No. 4,248,139. Typically the internal angle of the cone 78 would be about 60°. The drive motor 94 and associated drive arrangement may be replaced by an air drive in order to achieve very high rotational speeds of the unit 74. The unit 74 may be made from stainless steel, for example.

Any of the tow streams 10, 30, or 50, or the tow stream delivered to the unit 74 of FIG. 4, could comprise a mixture of fibres of different materials, e.g. from different sources. Separate tow streams may be at least partially mixed or otherwise combined upstream of or at the delviery rolls of a tow opening machine and additional mixing may take place up to the tongue of the filter rod making machine. The reservoir 64 and the tow spinning unit 74, for example, are effective at mixing fibres.

One type of fibre to be mixed with one or more other fibres may comprise an "activated" material, e.g. carbon, intended to provide an inreased filtering effect for the tow mixture.

The unit 74 could be used to entrain or trap carbon granules or other particulate filter material in the twists of the tow stream (which may but need not comprise a mixture of fibres of different materials).

Where the tow stream delivered to the apparatus is or is required to be treated with a plasticiser or other fluid additive prior to it entry into the garniture, the presence or otherwise of plasticiser may be detected, or the quantity of plasticiser on or in the tow may be measured, by an infra-red radiation source and associated detector. The infra-red beam may be scanned or tracked across the tow stream and may be arranged to measure thickness of a film of plasticiser on the tow.

I claim:

1. Apparatus for producing cigarette filter rod from a tow of filter material, comprising tow shaping means having a tongue for shaping the tow, rod forming means arranged downstream of the tow shaping means, means for opening the tow, and means for delivering a tow stream from said tow opening means to the rod forming means, including tow conveying means arranged upstream of the rod forming means and downstream of the tow opening means for conveying the tow, including means for spinning or twisting the tow so as to impart an axial thrust to the tow, the tow conveying means being arranged at least locally to reduce the longitudinal tension in the tow upstream of the rod forming means.

2. Apparatus as claimed in claim 1, wherein the tow conveying means is arranged to engage the tow in the same region as said tow shaping means.

3. Apparatus as claimed in claim 2, wherein the tow conveying means comprises means for conveying the tow into a downstream portion of the tow shaping means without stretching the tow in said portion.

4. Apparatus as claimed in claim 1, wherein the tow conveying means comprises pneumatic means for assisting conveyance of the tow towrds the tow shaping means.

5. Apparatus as claimed in claim 1, wherein the tow conveying means comprises pneumatic means for extracting air from the tow as it is compressed in the tow shaping means.

6. Apparatus for producing cigarette filter rod froma tow of filter material, comprising means having a tongue for shaping the tow, rod forming means arranged downstream of the tow shaping means, means for opening the tow, and means for delivering a tow stream from said tow opening means to the rod forming means, including tow conveying means arranged upstream of the rod forming means and downstream of the tow opening means for at least locally reducing the longitudinal tension in the tow upstream of the rod forming means, including a suction conduit extending longitudinally within the tow along the path of the tow in the tow shaping means.

7. Apparatus as claimed in claim 2, wherein the tow conveying means comprises spaced opposed members which engage the tow in the region of the tow shaping means.

8. Apparatus as claimed in claim 7, wherein said spaced opposed members carry a plurality of tow engaging projections.

9. Apparatus as claimed in claim 1, wherein a tow reservoir, in which the tow tension is reduced, is provided upstream of the tow shaping means.

10. Apparatus as claimed in claim 9, wherein a downstream portion of the tow reservoir has an exit for tow which is substantially the same size as that required for entry to the rod forming means.

11. Apparatus as claimed in claim 9, wherein the tow opening unit includes delivery means which is arranged to deliver tow at such speed that tension in the tow is relaxed.

12. Apparatus as claimed in claim 1, wherein the tow conveying means comprises a spinning unit thorugh which the tow passes and in which it is gathered.

13. Apparatus as claimed in claim 12, wherein the spinning unit comprises a converging portion positioned to receive the tow from said tow shaping means and means coupled to said converging portion for rotating said converging portion at high speed.

14. Apparatus as claimed in claim 1, wherein said means for spinning the tow to impart some axial thrust to the tow includes a tow engaging thread.

15. Apparatus as claimed in claim 2, wherein the spinning unit includes air transport means for aiding passage of tow through the unit.

16. Apparatus as claimed in claim 15, wherein the air transport means includes means for assisting the spinning or twisting of the tow.

17. Apparatus for producing cigarette filter rod from a tow of filter material, comprising means for feeding tow towards a rod making unit, and means upstream of the rod making unit for spinning or twisting the tow so as to impart an axial thrust to the tow, thereby at least locally reducing the longitudinal tension in the tow upstream of the rod making unit.

18. Apparatus as claimed in claim 17, wherein said spinning or twisting means includes means for entrailing particulate filtering material in the tow as it is twisted.

19. Apparatus as claimed in claim 1, wherein the tow conveying means comprises pneumatic means for assisting conveyance of the tow in the tow shaping means.

20. Apparatus as claimed in claim 1, wherein the tow conveying means comprises pneumatic means for extracting air from the tow upstream of the tow shaping means.

* * * * *